US007014671B2

(12) United States Patent
Oh

(10) Patent No.: US 7,014,671 B2
(45) Date of Patent: Mar. 21, 2006

(54) CYCLONE TYPE DUST COLLECTING APPARATUS OF VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 116 days.

(21) Appl. No.: 10/682,485

(22) Filed: Oct. 10, 2003

(65) Prior Publication Data

US 2004/0231305 A1 Nov. 25, 2004

(30) Foreign Application Priority Data

May 24, 2003 (KR) ..... 10-2003-0033167

(51) Int. Cl.
*B01D 45/12* (2006.01)

(52) U.S. Cl. ..... 55/337; 55/345; 55/429; 55/459.1; 55/DIG. 3

(58) Field of Classification Search ..... 55/337, 55/343, 345, 429, 426, 459.1, DIG. 3
See application file for complete search history.

(56) References Cited

U.S. PATENT DOCUMENTS 6,344,064 B1 2/2002 Conrad
6,746,500 B1 6/2004 Park et al.
6,782,585 B1 * 8/2004 Conrad et al. ..... 15/353
2003/0159412 A1 8/2003 North

FOREIGN PATENT DOCUMENTS

EP 0836827 A1 * 10/1996
GB 2330786 A 5/1999
GB 2367019 A 3/2002

(Continued)

(Continued)

OTHER PUBLICATIONS

Combined Search and Examination Report (issued Jul. 16, 2004) issued from the British Patent Office for British Patent Application No.: 0401236.5, filed Jan. 20, 2004.

(Continued)

*Primary Examiner*—Robert A. Hopkins
(74) *Attorney, Agent, or Firm*—Blank Rome LLP

(57) ABSTRACT

A cyclone type dust collecting apparatus of a vacuum cleaner. The apparatus includes a lower cyclone body for centrifuging and collecting large-sized foreign substances contained in inhaled outside air. At least one upper cyclone body is disposed at an upper portion of the lower cyclone body for centrifuging and collecting small-sized foreign substances contained in air discharged from the lower cyclone body. Inhaled foreign substances are sequentially centrifuged in order of size thereof, by the lower and upper cyclone bodies.

8 Claims, 6 Drawing Sheets

FOREIGN PATENT DOCUMENTS

| | | | |
|---|---|---|---|
| GB | 2367510 | A | 4/2002 |
| GB | 2367511 | A | 4/2002 |
| GB | 2367512 | A | 4/2002 |
| GB | 2367774 | A | 4/2002 |
| GB | 2372434 | A | 8/2002 |
| GB | 2374305 | A | 10/2002 |
| GB | 2381484 | A | 5/2003 |
| GB | 2395678 | A | 6/2004 |
| JP | 08-322769 | | 12/1996 |
| WO | WO 00/74548 | | 12/2000 |
| WO | WO 01/60524 | | 8/2001 |
| WO | WO 02/03844 | | 1/2002 |
| WO | WO 02/03845 | | 1/2002 |
| WO | WO 02/069778 | | 9/2002 |

OTHER PUBLICATIONS

French Office Action dated Dec. 2, 2004.

Translation of Russian Office Action dated Dec. 15, 2004.

Australian Patent Office Action issued Feb. 16, 2005 in connection with corresponding Application No. 2003261525.

Patent Abstracts of Japan—08-322769.

* cited by examiner

CYCLONE TYPE DUST COLLECTING APPARATUS OF VACUUM CLEANER

FIELD OF THE INVENTION

The present invention relates generally to a cyclone type dust collecting apparatus of a vacuum cleaner, and more particularly, to a dust collecting apparatus having two cyclones, in which dust-containing foreign substances in an air stream are collected through plural times of centrifuging processes.

BACKGROUND OF THE INVENTION

As shown in FIG. 1, a conventional cyclone type dust collecting apparatus 100 comprises a cyclone body 110 and a filter 130 disposed in the cyclone body 110. A reference numeral 3 designates a main body of the vacuum cleaner (FIG. 2). The cyclone type dust collecting apparatus 100 is disposed in a receiving portion 10 of the main body 3. The main body 3 is provided with an inlet connecting pipe 13 (FIG. 2) and an outlet connecting pipe 14 at a rear portion of the receiving portion to introduce air containing a foreign substance into the cyclone type dust collecting apparatus 100. The outlet connecting pipe 14 (FIG. 2) exhausts purified air in which foreign substances are removed by the cyclone type dust collecting apparatus 100.

The cyclone body 110 is provided with an inlet port 113 and an outlet port 115. A dust collecting container 120 is removably connected to a lower side of the cyclone body 110. The inlet port 113 is formed at a side surface of the cyclone body 110 in a tangential direction, and coupled to the inlet connecting pipe 13 of the main body 3. The air introduced through the inlet connecting pipe 13 is discharged through the inlet port 113 to the cyclone body 110 and then forms a vortex current. The foreign substance contained in the air is separated by a centrifugal force of the vortex current and collected in the dust collecting container 120.

The outlet port 115 is formed at a center portion of an upper surface of the cyclone body 110 and connected to the outlet connecting pipe 14 of the main body 3. Thus, air in which the foreign substance is separated by the centrifugal force can be exhausted through the outlet connecting pipe 14.

A filter 130 is disposed within the dust collecting container 120, as coupled to an opening surface of the outlet port 115. The filter 130 filters fine dust included in the air stream in which foreign substances are separated by the centrifugal force. Air passing through the filter 130 is exhausted through the outlet connecting pipe 14 to the outside. The filter 130 also functions to prevent a backflow of air.

However, in the conventional cyclone type dust collecting apparatus 100 for a vacuum cleaner, foreign substances separated by the centrifugal force and collected in the dust collecting container are floated with an ascending air current, and thus collide with the filter or attach to an outer surface of the filter. Therefore, a smooth flow of the air stream is disturbed and noise is also generated. In case so much foreign substances are contained in the air stream, it is difficult to fully utilize the filtering function of the single filter disposed in the conventional cyclone type dust collecting apparatus. Furthermore, it is inconvenient because the filter needs to be replaced frequently.

SUMMARY OF THE INVENTION

An object of the invention is to solve at least the above-identified problems and/or disadvantages and to provide at least the advantages described hereinafter.

Therefore, it is an object of the present invention to provide a cyclone type dust collecting apparatus of a vacuum cleaner[] in which foreign substances contained in air sucked from an outside, are collected through plural times of centrifuging processes in order of size thereof.

It is another object of the present invention to provide a cyclone type dust collecting apparatus of a vacuum cleaner, which can reduce noise and also improve a dust collecting efficiency.

It is another object of the present invention to provide a cyclone type dust collecting apparatus of a vacuum cleaner, which can increase a life span of a filter function.

To achieve the above objects and/or other features of the present invention, there is provided a cyclone type dust collecting apparatus of a vacuum cleaner including a lower cyclone body for centrifuging and collecting large foreign substances contained in air introduced from an outside, and at least one or more upper cyclone bodies disposed at an upper portion of the lower cyclone body, for centrifuging and collecting small foreign substances contained in air discharged from the lower cyclone body in order of particle size.

The upper and lower cyclone bodies are divided in a casing and respectively provided with an inlet port for discharging the air thereinto and an outlet portion for exhausting air in which foreign substances are centrifuged. The lower outlet port of the lower cyclone body and the upper inlet portion of the upper cyclone body are communicated with each other by an air path including an inner guiding portion formed at an inner portion of the casing and an outer guiding portion formed at an outer portion of the casing.

According to the present invention, since foreign substance contained in air sucked from an outside can be sequentially centrifuged in the lower cyclone body and the upper cyclone body according to a size of particle of the foreign substance, a cleaning efficiency of the cyclone type dust collecting apparatus can be increased. Further, the cyclone type dust collecting apparatus has an improved dust collecting performance and a reduced noise.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

A height adjusting apparatus for a cyclone type dust collecting apparatus according to a preferred embodiment of the present invention will be described in detail with reference to the annexed drawings.

Figure 1:
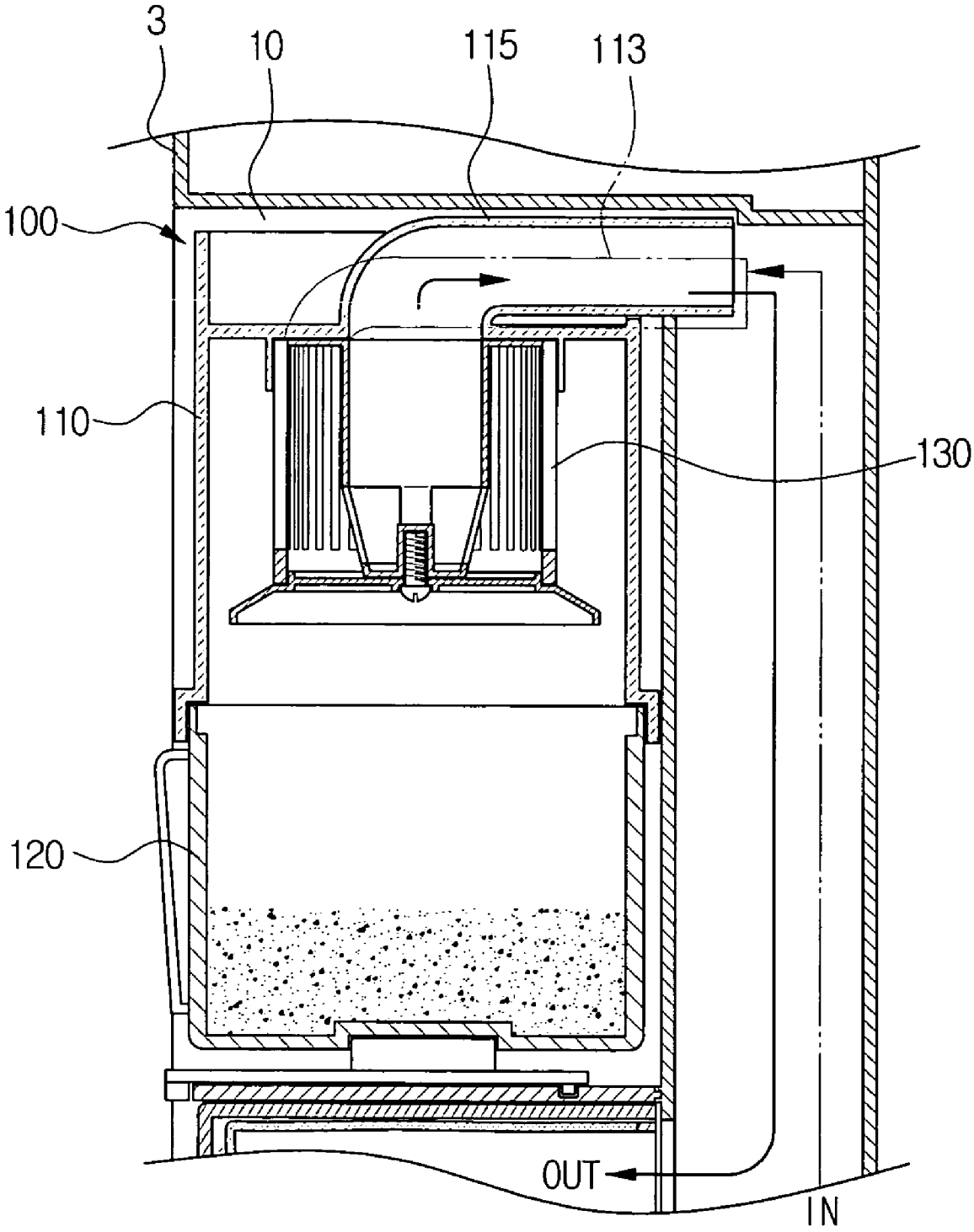
FIG. 1 (PRIOR ART)
FIG. 1 is a longitudinal cross-sectional view of a vacuum cleaner with a conventional cyclone type dust collecting apparatus.
Figure 2:
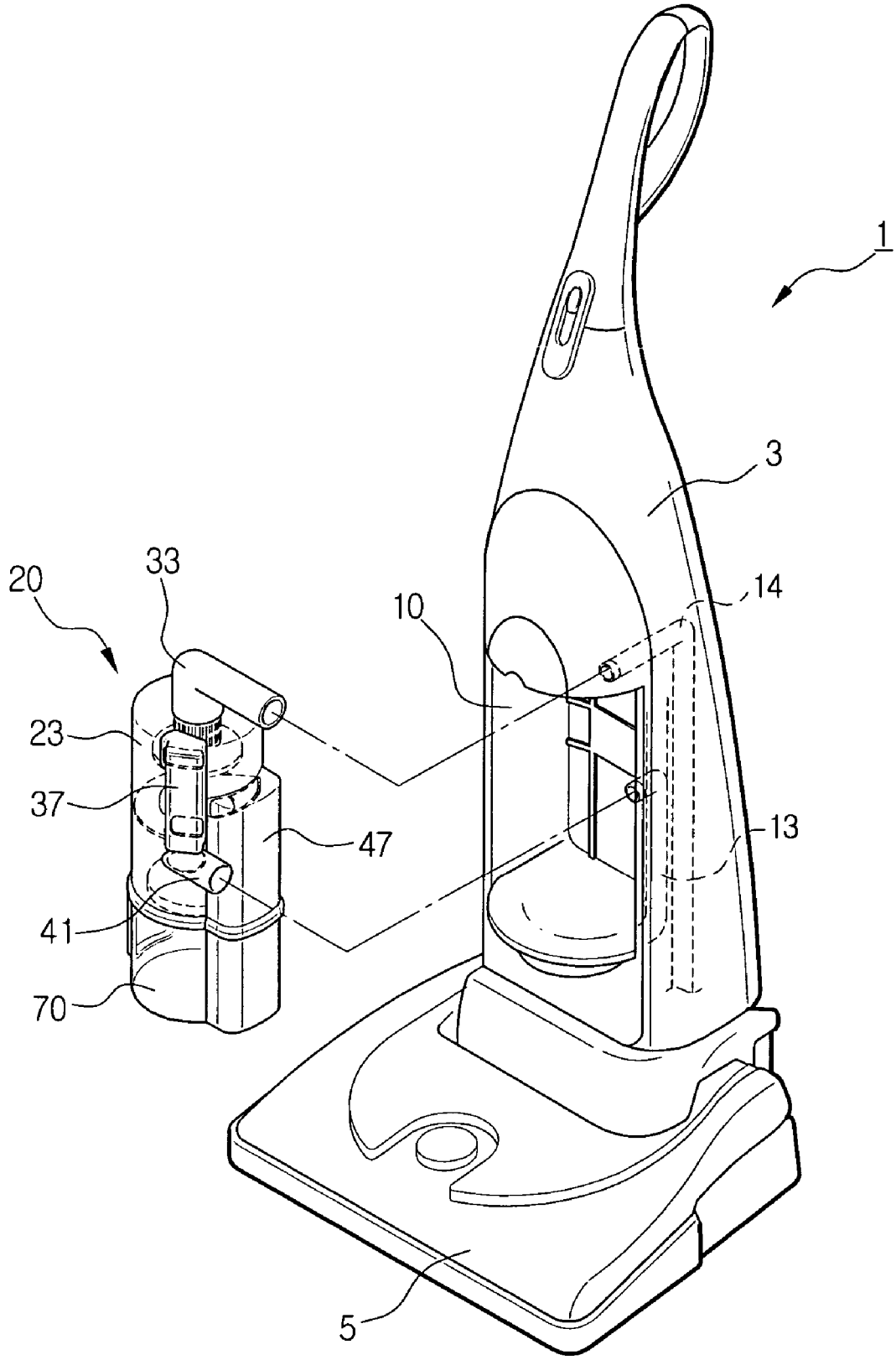
FIG. 2 is a perspective view of an upright cyclone vacuum cleaner with a cyclone type dust collecting apparatus according to a preferred embodiment of the present invention.

FIG. 2 is a perspective view of an upright cyclone vacuum cleaner with a cyclone type dust collecting apparatus according to the present embodiment. As shown in FIG. 2, an upright cyclone vacuum cleaner 1 comprises a main body 3 and a cyclone type dust collecting apparatus 20 removably disposed in the main body 3.

The main body 3 is provided with a built-in vacuum generating device (not shown) and a suction brush 5 disposed at a lower portion thereof to suck foreign substances with air from the outside thereinto. A recessed receiving portion 10 is formed at a center portion of the main body 3, for removably receiving the cyclone type dust collecting apparatus 20. An inlet connecting pipe 13 and an outlet connecting pipe 14 are disposed at a rear side of the receiving portion 10, i.e., in an inner portion of the main body 3. The inlet connecting pipe 13 is connected with the suction brush 5. The outlet connecting pipe 14 is coupled to the vacuum generating device.

Figure 3:
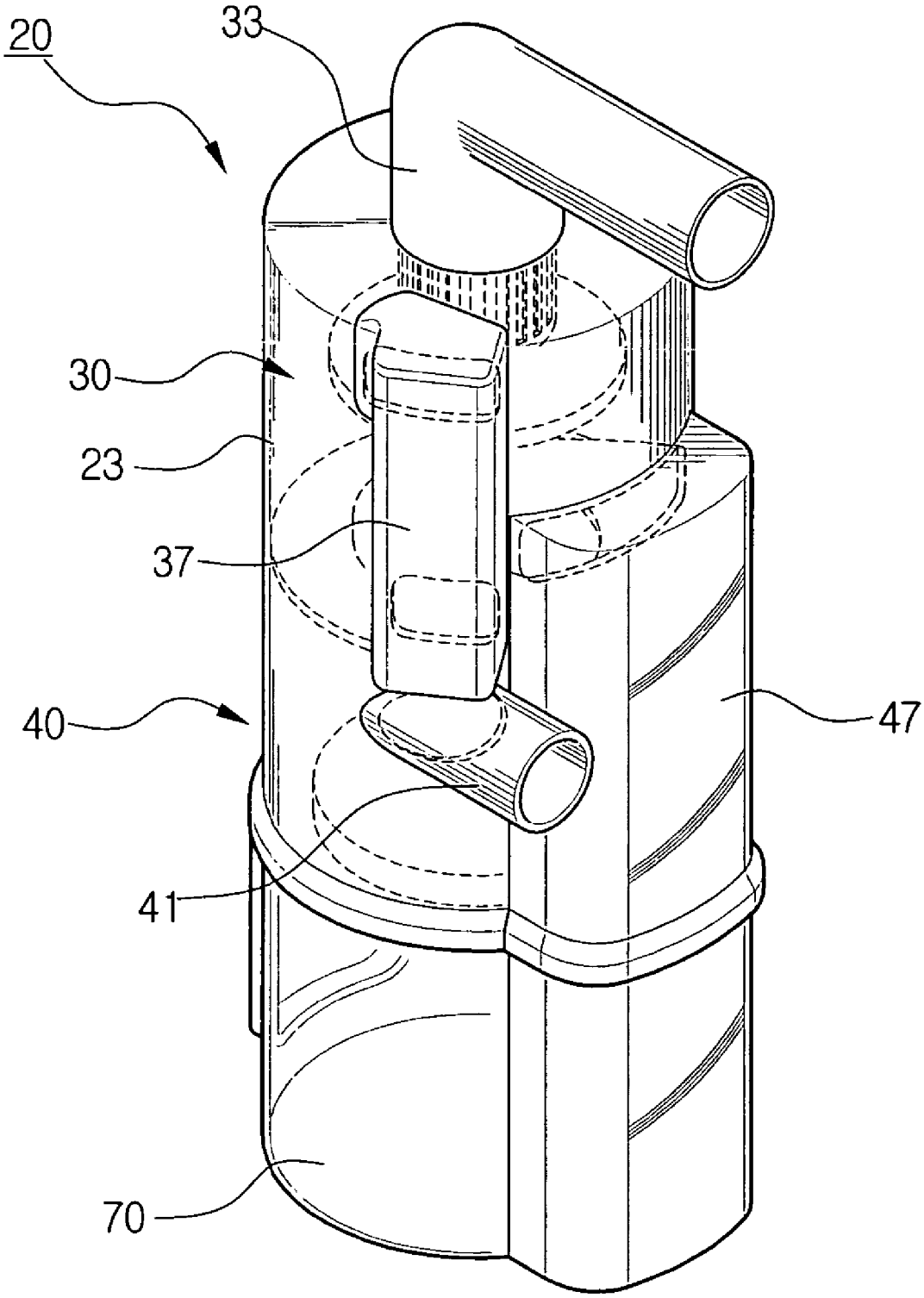
FIG. 3 is an enlarged view of FIG. 2, showing the shape of the cyclone type dust collecting apparatus.
Figure 4:
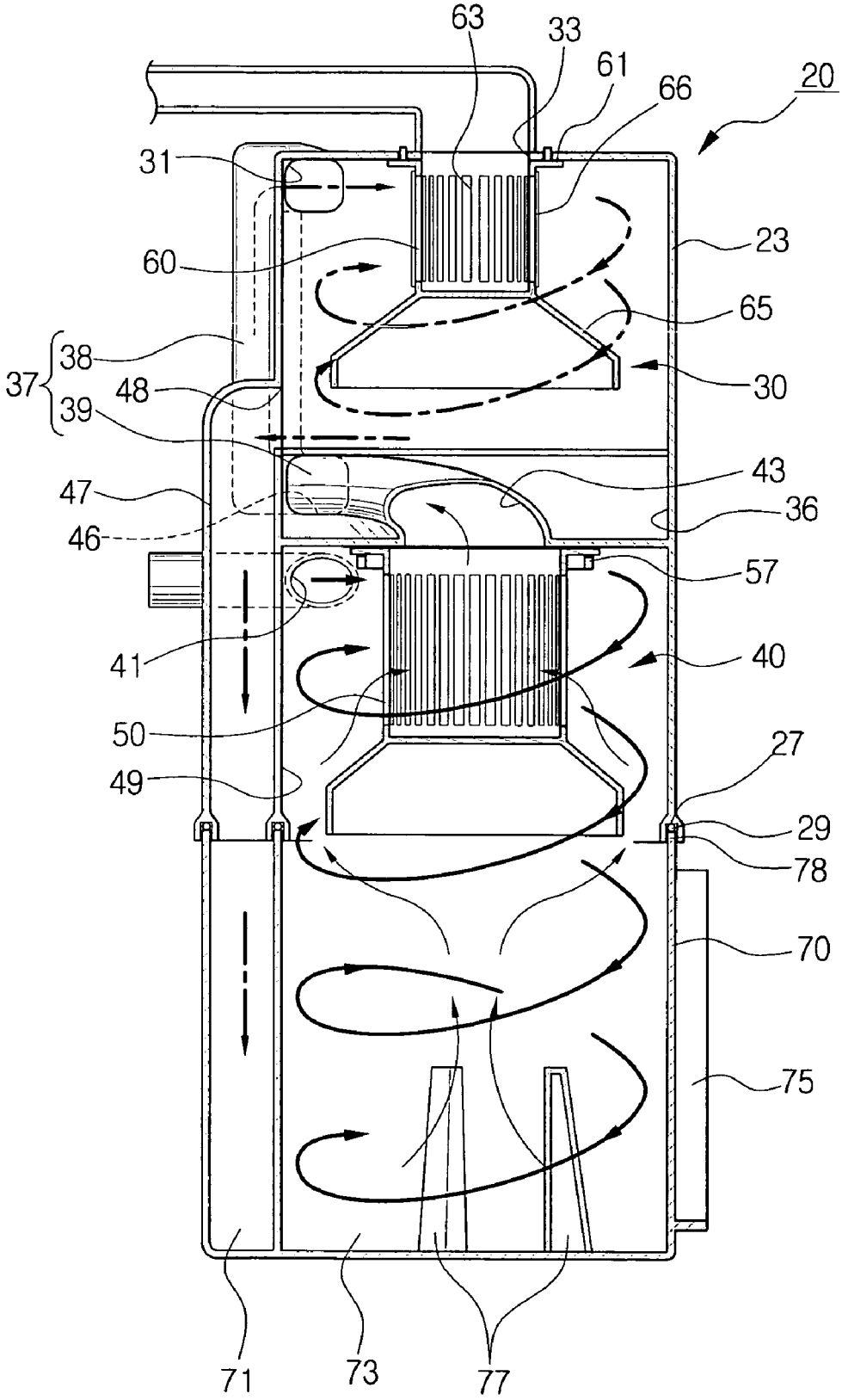
FIG. 4 is a longitudinal cross-section view of FIG. 3.
Figure 5:
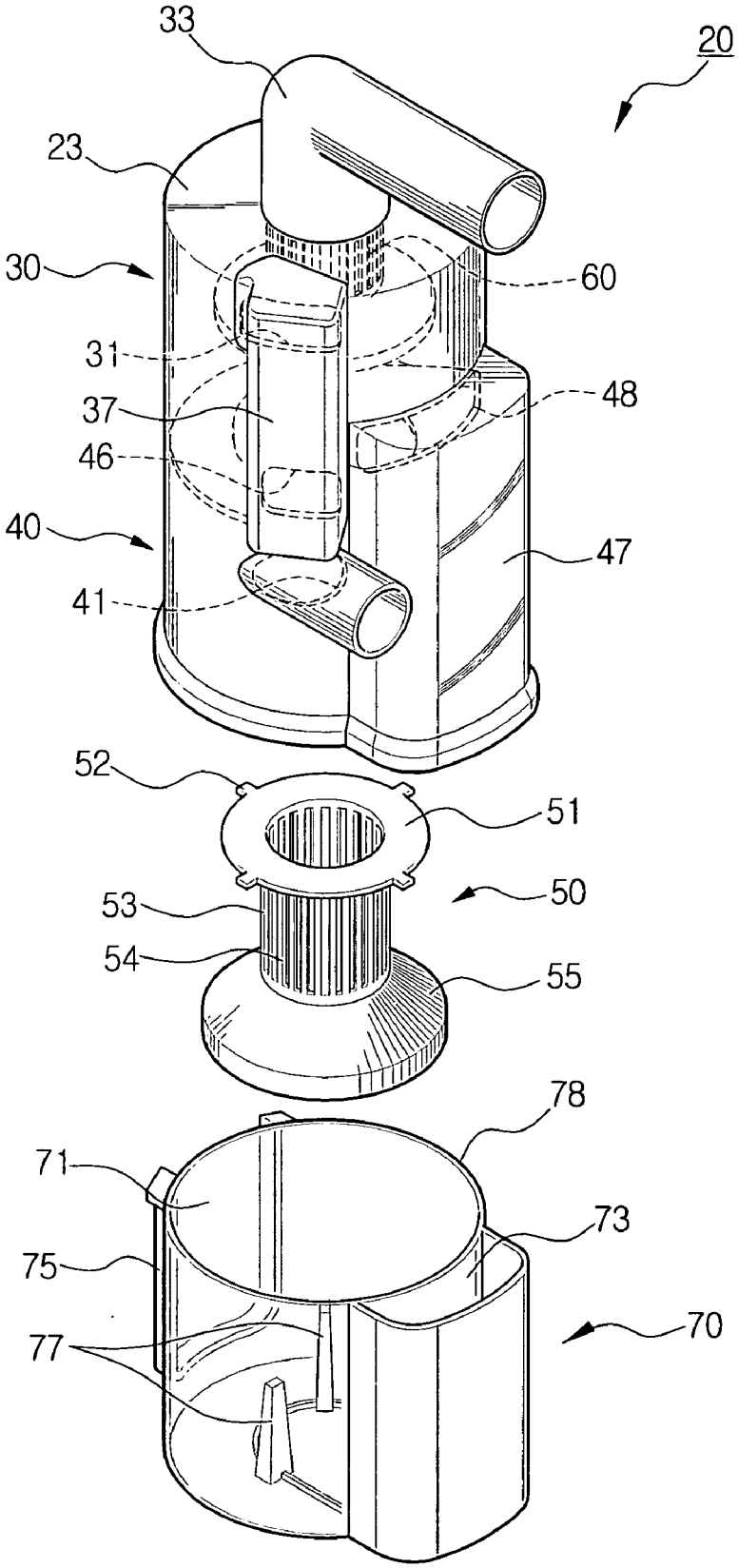
FIG. 5 is an exploded perspective view of FIG. 4.

FIG. 3 is an enlarged view of FIG. 2, showing the shape of the cyclone type dust collecting apparatus, and FIG. 4 and FIG. 5 show the cyclone type dust collecting apparatus in detail. As shown in these drawings, the cyclone type dust collecting apparatus 20 comprises a lower cyclone body 40 coupled to the inlet connecting pipe 13 of the main body 3 and an upper cyclone body 30 disposed at an upper side of the lower cyclone body 40 coupled to the outlet connecting pipe 14. The lower and upper cyclone bodies 40, 30 are communicated with each other through an air path 37.

The lower and upper cyclone bodies 40, 30 are integrally provided with a cylindrical casing 23, and partitioned into a lower portion and an upper portion in the casing 23. A space 36 is formed between the lower and upper cyclone bodies 40, 30. Suction ports 31, 41 are formed at an upper side of each of cyclone bodies 30, 40. The suction ports 31, 41 are formed toward an inner portion of each corresponding cyclone bodies 30, 40 in a tangential direction. Outlet ports 33, 43 are formed at a center portion of an upper surface of each of cyclone bodies 30, 40.

The air path 37 communicates with the lower outlet port 43 of the lower cyclone body 40 and the upper inlet port 31 of the upper cyclone body 30. The air path 37 can be divided into an inner guiding portion 39 formed at an inner portion of the casing 23 and an outer guiding portion 38 formed at an outer portion of the casing 23. The inner guiding portion 39 communicates the lower outlet port 43 of the lower cyclone body 40 and a through-hole 46 formed at an outer surface of the space 36. The inner guiding portion 39 is inclined at a desired angle with respect to a vertical axial line. The outer guiding portion 38 communicates the through-hole 46 formed at the outer surface of the space 36 and the upper inlet port 31 of the upper cyclone body 30.

A grill 50 is disposed at the lower outlet port 43 of the lower cyclone body 40, and a plurality of coupling jaws 57 are formed along an opened circumference of the lower outlet port 43. As shown in FIG. 5, the grill 50 can be divided into three portions, i.e., a grill portion 53 in the center, an upper coupling portion 51 and a lower skirt portion 55. A plurality of grill holes 54 is formed at the grill portion 53 in a circumferential direction. The grill holes 54 prevent the foreign substance having a desired size from passing through. The upper coupling portion 51 is formed with a plurality of protruded ribs 52 engaged with the coupling jaws 57 of the lower outlet port 43. The lower skirt portion 55 has a larger sectional diameter than the grill portion 53. The lower skirt portion 55 prevents the foreign substances from floating with a vortex current of air.

A filter 60 is disposed at the upper outlet port 33 of the upper cyclone body 30. The filter 60 is also divided into a filtering portion 63 in the center, an upper coupling portion 61 and a lower skirt portion 65. Since the upper coupling portion 61 and the lower skirt portion 65 have the similar structure as the grill 50, a detailed description thereof will be omitted. The filtering portion 63 is formed with a plurality of grill windows at an outer circumference thereof A net-shaped filtering member 66 is preferably attached to an outer surface of the grill window. Herein, the net-shaped filtering member 66 can filter fine dust as well as the foreign substances.

Figure 6:
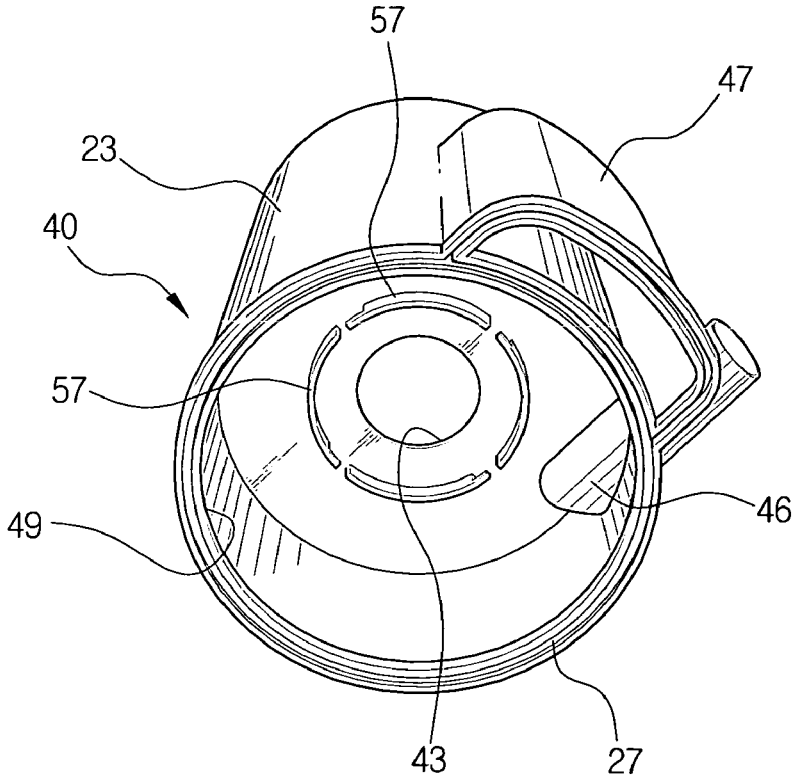
FIG. 6 is a lower perspective view of a cyclone body of FIG. 5.

Meanwhile, a lower surface of the lower cyclone body 40 is formed with an opening 49. A dust collecting container 70 is removably disposed at the opening 49. FIG. 6 is a lower perspective view of the casing integrally provided with the lower cyclone body and the upper cyclone body. Referring to FIG. 6, the opening 49 of the lower cyclone body 40 is formed at a bottom surface of the casing 23 forming the cyclone bodies 30, 40. And a groove 27 is formed at a circumference of the opening 49 of the lower cyclone body 40 in a circumferential direction of the lower cyclone body 40.

Figure 7:
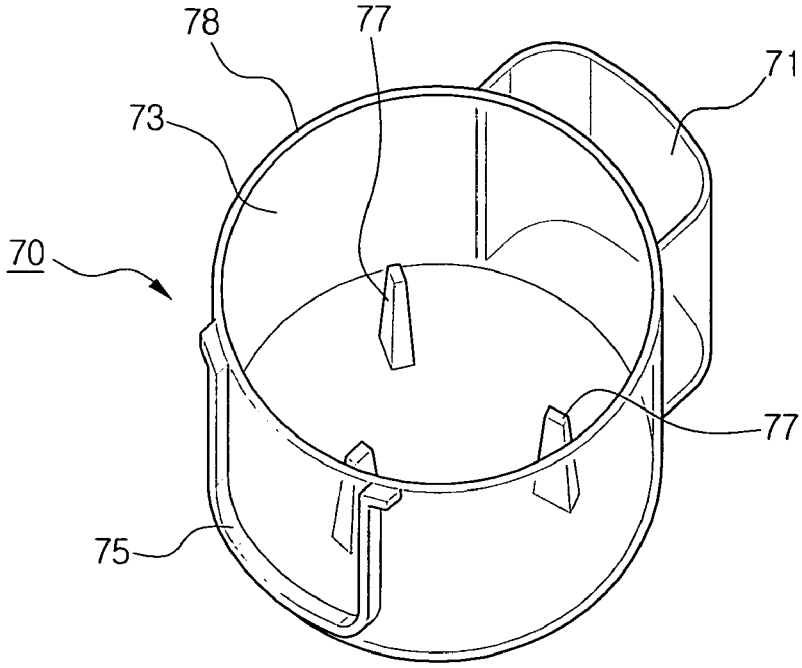
FIG. 7 is an upper perspective view of a dust collecting container of FIG. 2.

As shown in FIG. 7, an engaging end 78 is formed at an upper opening of the dust collecting container 70. The engaging end 78 of the dust collecting container 70 is fitted to the groove 27 of the lower cyclone body 40. A handle 75 is formed at an outer surface of the dust collecting container 70. A plurality of supporting protrusions 77 are formed on a bottom surface of the dust collecting container 70. The supporting protrusions 77 function to support the grill 50 disposed in the lower cyclone body 40, and, at the same time, assist in a smooth flow of the vortex current therein.

The dust collecting container 70 is partitioned into a lower dust collecting portion 73 for receiving the foreign substances separated by the lower cyclone body 40 and an upper dust collecting portion 71 for receiving the foreign substances separated by the upper cyclone body 30. The lower dust collecting portion 73 forms a large portion of the dust collecting container 70 to collect large-sized foreign substances filtered by the grill 50. The upper dust collecting portion 71 is provided at a side of the lower dust collecting portion 73 to collect foreign substances having a relatively small size which are filtered by the filter 60.

The dust collecting container 70 and the upper cyclone body 30 are connected to each through a dust guiding path 47. The dust guiding path 47 communicates the upper dust collecting portion 71 of the dust collecting container 70 and a dust exhausting hole 48 formed at a lower side portion of the upper cyclone body 30. As shown in FIG. 6, the dust guiding path 47 is formed along the outer surface of the casing 23.

Hereinafter, the operation of the cyclone type dust collecting apparatus will be described.

The cyclone type dust collecting apparatus 20 is disposed in the receiving portion 10 of the main body 3 in a desired direction. The lower inlet port 41 is coupled to the inlet connecting pipe 13 exposed to the receiving portion 10 of the main body 3, and the upper outlet port 33 of the upper cyclone body 30 is coupled to the outlet connecting pipe 14. In this situation, if the vacuum cleaner is switched on, the vacuum generating device is driven. The external air containing foreign substances is sucked through the suction brush 5, and discharged through the inlet connecting pipe 13 into the lower inlet port 41 of the lower cyclone body 40.

Air discharged into the lower inlet port 41 forms the vortex current in the lower cyclone body 40, and thus the foreign substance is firstly centrifuged. Then, the air in which the foreign substances are separated passes through the grill 50, and ascends along the air path 37. The grill 50 prevents the passing of the relatively large-sized foreign substances. Therefore, the large-size foreign substances are collected in the lower dust collecting portion 73 of the dust collecting container 70.

Meanwhile, air ascending along the air path 37 is discharged through the upper inlet port 31 into the upper cyclone body 30 and also forms the vortex current. Thus, foreign substances contained in the vortex current are secondly centrifuged. Air in which the foreign substances are centrifuged in the upper cyclone body 30 is passed through the filter 60 and exhausted through the outlet connecting pipe 14. The filter 60 filters fine dust as well as small-sized foreign substances contained in the air stream. Therefore, only the purified air is exhausted through the outlet connecting pipe 14. Herein, since the filter 60 filters air which is firstly filtered in the lower cyclone body 40, a filtering efficiency is improved and a life span thereof is also prolonged. Meanwhile, the fine dust and the small-sized foreign substances are stacked on the bottom of the upper cyclone body 30. The fine dust and the foreign substances stacked on the bottom surface are spinning around by the wind force formed by the vortex current and discharged through the dust exhausting hole 48 formed at the lower portion of the upper cyclone body 30. The fine dust and the foreign substances are moved along the dust guiding path 47, and collected in the upper dust collecting portion 71 of the dust collecting container 70.

If the amount of the foreign substances collected in the dust collecting container 70 is greatly increased, accordingly, as a desired time passes, a user grasps the handle 75 and detaches the dust collecting container 70 to remove the collected foreign substances. The dust collecting container 70 that collected the foreign substance is removed and can be easily coupled again by fitting the engaging end 78 thereof with the groove 27 of the lower cyclone body 40.

However, in the above mentioned embodiment and drawings, it is described that the dust collecting container 70 is partitioned into the upper dust collecting portion 71 and the lower dust collecting portion 73. The dust collecting container can be modified into an upper cyclone body 30 and a lower cyclone body 40 which are independently and detachably disposed.

According to the present iembodiment, as described above, since foreign substances contained in air sucked from an outside can be sequentially centrifuged in the lower cyclone body and the upper cyclone body according to a particle size of the foreign substance, the cleaning efficiency of the cyclone type dust collecting apparatus can be increased. Further, the cyclone type dust collecting apparatus of the present embodiment has an improved dust collecting performance and a reduced noise.

In addition, the cyclone type dust collecting apparatus of the present embodiment can be applied to various types of vacuum cleaners employing a cyclone type dust collecting method as well as the upright vacuum cleaner.

Furthermore, the cyclone type dust collecting apparatus of the present embodiment may have a plurality of cyclone bodies.

While the present invention has been described in detail, it should be understood that various changes, substitutions and alterations can be made hereto without departing from the spirit and scope of the invention as defined by the appended claims.

What is claimed is:

1. A cyclone type dust collecting apparatus of a vacuum cleaner, comprising:

a lower cyclone body for centrifuging and collecting large foreign substances contained in air introduced from an outside;

at least one upper cyclone bodies disposed at an upper portion of the lower cyclone body, for centrifuging and collecting small foreign substances contained in air discharged from the lower cyclone body in order of particle size; and a dust collecting container detachably disposed at the lower cyclone body, for collecting the centrifuged foreign substances centrifuged in the upper cyclone body and the lower cyclone body.

2. The apparatus of claim 1, wherein the upper and lower cyclone bodies are divided in a casing and respectively provided with an inlet port for discharging air thereinto, and an outlet portion for exhausting air in which foreign substances are centrifuged, and a lower outlet port of the lower cyclone body and the upper inlet portion of the upper cyclone body are communicated with each other by an air path including an inner guiding portion formed at an inner portion of the casing and an outer guiding portion formed at an outer portion of the casing.

3. The apparatus of claim 2, further comprising a foreign substance removing means disposed at an upper outlet port of the upper cyclone body and the lower outlet port of the lower cyclone body.

4. The apparatus of claim 3, wherein the foreign substance removing means disposed at the lower outlet port includes a grill for filtering large-size foreign substance, and the foreign substance removing means disposed at the upper outlet port includes a filter for filtering small-size foreign substances passing through the grill.

5. The apparatus of claim 1, further comprising an upper dust collecting container and a lower dust collecting container, associated with the upper and lower cyclone bodies respectively, for collecting the centrifuged foreign substance.

6. The apparatus of claim 1, further comprising a dust guiding path for guiding the foreign substance centrifuged in the upper cyclone body to the dust collecting container.

7. The apparatus of claim 6, wherein the dust collecting container is partitioned into an upper dust collecting portion for collecting the foreign substance centrifuged in the upper cyclone body and a lower dust collecting portion for collecting the foreign substance centrifuged in the lower cyclone body.

8. The apparatus of claim 7, wherein the lower cyclone body is provided with a groove formed at a lower circumferential portion thereof, and the dust collecting container is provided with an engaging end formed at a upper circumferential portion thereof fitted to the groove.

* * * * *